United States Patent [19]

Hughes

[11] 3,959,825

[45] June 1, 1976

[54] REVERSIBLE NECKTIE

[76] Inventor: John A. Hughes, 8031 S. Shore Drive, Chicago, Ill. 60617

[22] Filed: May 2, 1975

[21] Appl. No.: 573,881

[52] U.S. Cl. ..... 2/146; 2/155
[51] Int. Cl.[2] ..... A43D 25/06
[58] Field of Search ..... 2/144, 146, 150, 155

[56] References Cited

UNITED STATES PATENTS

| | | | |
|---|---|---|---|
| 1,122,946 | 12/1914 | Keys | 2/155 |
| 1,495,815 | 5/1924 | Singer | 2/146 |
| 1,803,388 | 5/1931 | Hall | 2/146 |
| 1,962,437 | 6/1934 | Elgin | 2/146 |
| 2,024,151 | 12/1935 | Dombrowsky | 2/146 |
| 2,185,615 | 1/1940 | Willmoth | 2/146 |
| 2,825,904 | 3/1958 | Klaus | 2/146 |
| 3,264,654 | 8/1966 | Woronowicz et al. | 2/146 |
| 3,744,057 | 7/1973 | Luceri | 2/146 |

*Primary Examiner*—G. V. Larkin
*Attorney, Agent, or Firm*—Anthony S. Zummer

[57] ABSTRACT

A reversible four-in-hand necktie is herein disclosed, which has a first side bearing a first pattern. A second side, bearing a different pattern, is connected to the first side. The first and second sides are symmetric; and together form a pair of relatively wide end portions, which are connected by a narrow neck portion positioned between the end portions. The reversible four-in-hand necktie is used and worn as any other four-in-hand necktie, with the exception that either the first or second side is worn facing outward from the wearer.

2 Claims, 4 Drawing Figures

REVERSIBLE NECKTIE

BACKGROUND OF THE INVENTION

Four-in-hand neckties are, per se, old in the art. The conventional four-in-hand necktie, however, suffers from a number of limitations.

The front of the conventional necktie may become soiled through normal use; or accidents may occur, such as food being spilled upon the necktie, which soil the necktie. When the conventional necktie is soiled, it usually must by dry cleaned. If the soiling takes place upon a social occasion, it is difficult, if not in most cases impossible, to have the necktie cleaned since the wearer would then be without a necktie. As a result, the wearer is forced to continue wearing the necktie with the soil exposed, which can be a source of embarrassment.

Conventional neckties are manufactured with a considerable fraction of hemming material continued from the front side of the tie around to the rear. This use of excess material increases the cost of manufacturing the necktie, which is, of course, passed on to the customer.

Conventional neckties, although usually moderately priced items, do consume a substantial fraction of any man's clothing budget. Men often find it desirable to have a separate necktie to be worn with each dress shirt they own. As a consequence, the purchase of a number of shirts often necessitates the purchase of a similar number of neckties to be worn with the shirts.

What is needed is a reversible necktie having two patterned sides. The reversible necktie should be of a symmetric construction in order that either of the two sides may be worn with equal ease and sartorial splendor.

SUMMARY OF THE INVENTION

The present invention relates to a reversible four-in-hand necktie having a pair of opposite symmetric sides. The first side of the pair has one pattern or color; and the second side of the pair has a pattern or color different from that found on the first side. Since the sides are symmetric, by definition, both sides exhibit the same dimensions and contours.

The sides form a pair of relatively wide end portions. The wide end portions are connected by a relatively narrow neck portion, positioned between the end portions. The inventive reversible four-in-hand necktie is used and worn in the same fashion as any conventional necktie. In addition, the reversible four-in-hand necktie has the added advantage that either side may be worn facing outward from the wearer.

It is therefore a principal object of the present invention to provide a reversible four-in-hand necktie which is symmetric; and may be worn with either side facing outward.

It is a further object of the instant invention to provide a reversible four-in-hand necktie which may be quickly and easily reversed if one side becomes soiled.

It is a still further object of the present invention to provide a reversible four-in-hand necktie which uses relatively small amounts of hemming material; and is therefore economical to produce and purchase.

Other objects and uses of the present invention will become obvious to one skilled in the art upon a perusal of the following specification in light of the accompanying drawing.

DESCRIPTION OF THE PREFERRED EMBODIMENT

Figures 1, 2, 3, 4:
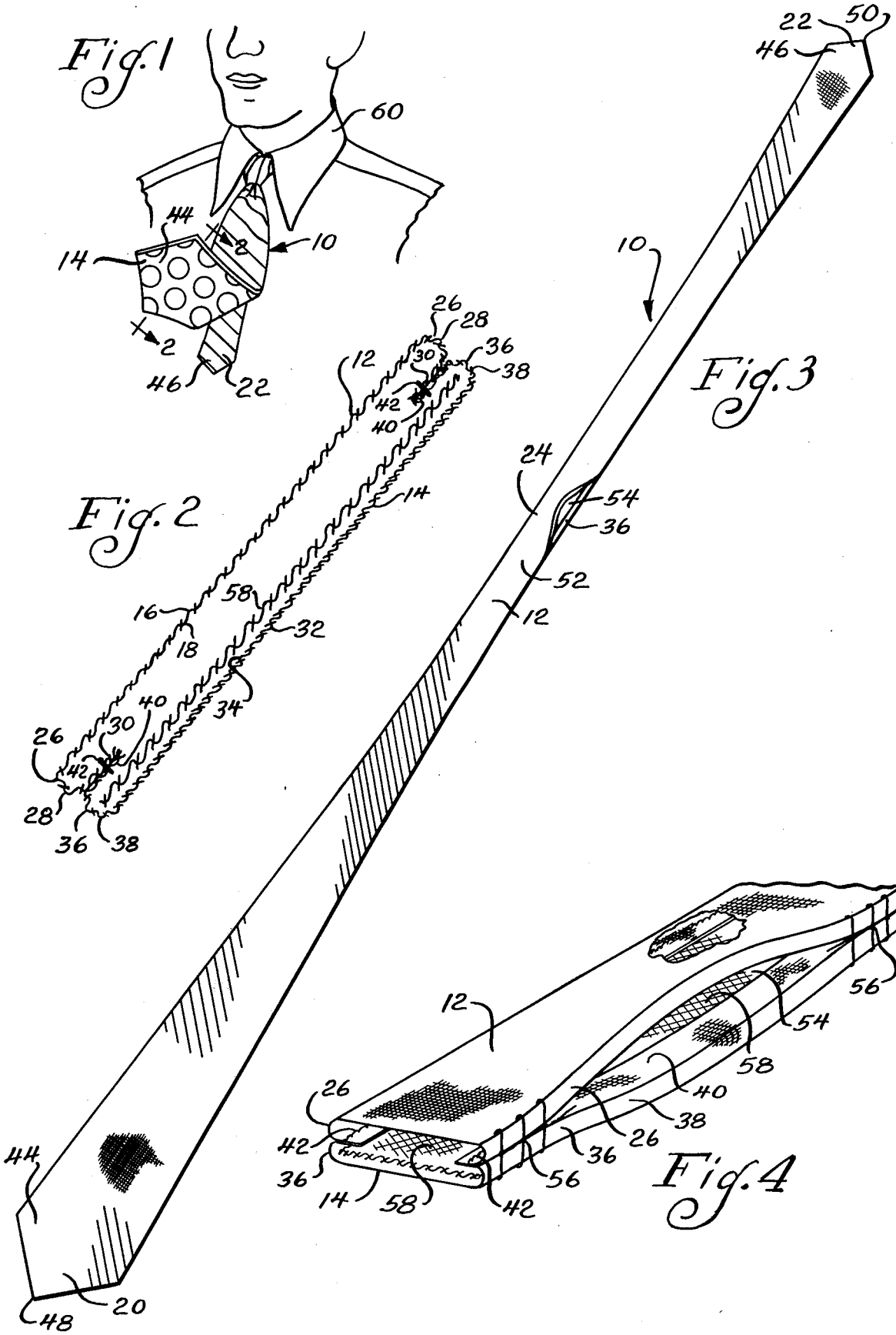
FIG. 1 is a perspective view of the reversible four-in-hand necktie, as it is worn, with a portion of the wider of the ends lifted to show a portion of the second side.
FIG. 2 is a cross-sectional view of the reversible four-in-hand necktie of FIG. 1, taken along Line 2—2.
FIG. 3 is a plan view of the reversible four-in-hand necktie of FIG. 1, showing a gap between the hems of the neck portion.
FIG. 4 is a perspective view of a part of the neck portion of the reversible four-in-hand necktie of FIG. 3, with portions of a side and a lock stitch broken away to show the interior.

Referring now to the drawings, and especially to FIGS. 1 and 3, a reversible four-in-hand necktie 10 is generally shown therein. Reversible necktie 10 has a first side 12; and a second side 14 connected opposite side 12. Sides 12 and 14 are symmetric, that is, they have the same contours and dimensions.

Side 12 has an outside face 16; and an inside face 18. Outside face 16 of side 12 has a pair of relatively wide pointed ends 20 and 22 formed integral with a relatively narrow neck band 24 therebetween. Pointed end 20 is wider than pointed end 22. Outside face 16 of side 12 bears a selected color and/or pattern. The specific embodiment herein described discloses outside face 16 as having a broad striped pattern. However, any other pattern or color would be equally suitable; and is purely a matter of personal preference. Side 12 also has an inwardly-curving first bordering hem 26, extending around side 12. Hem 26 has a curved portion 28 formed integral with faces 16 and 18, and a flat portion 30 formed integral with curved portion 28.

Side 14 has an outside face 32; and an inside face 34. Outside face 32 of side 14 is symmetric with outside face 16 of side 12. Outside face 32 of side 14 also bears a selected color and/or pattern. In this instance, outside face 32 bears a polkadot pattern. However, any other pattern or color would be equally suitable; and selection of a particular color or pattern is purely a matter of personal preference. Side 14 has an inwardly-curving second bordering hem 36, which is symmetric with hem 26, extending around side 14. Hem 36 has a curved portion 38 formed integral with faces 32 and 34, and a flat portion 40 formed integral with curved portion 38.

Referring now to FIGS. 2 and 4, sides 12 and 14 are connected at flat portions 30 and 40 of hems 26 and 36, respectively, by an inside stitch line 42. Outside faces 16 and 32 of sides 12 and 14, respectively, together form a pair of relatively widened pointed end portions 44 and 46 at ends 20 and 22, respectively. End portion 44 is wider than end portion 46. End portion 44 tapers to a point 48. Likewise, end portion 46 tapers to a point 50. Both flat portions 30 and 40 of hems 26 and 36, respectively, are symmetrically tapered at points 48 and 50. End portions 44 and 46 are connected together by a relatively narrow neck portion 52 at narrow neck band 24 of outside face 16. Stitch line 42 extends around reversible necktie 10; and is broken at neck portion 52 so that hems 26 and 36 form a gap 54. A short length of an outside lock stitch 56 connects the portions of hems 26 and 36, which form gap 54.

A woven interfacing material 58 (having the same shape as outside faces 16 and 32, but smaller dimensions) lies between inside face 32 of side 14 and flat portion 40 of hem 36, as well as a portion of inside face 16 of side 12. Interfacing 58 is contiguous with curved portion 38 of hem 36. Interfacing 58 provides support to sides 12 and 14, prevents wrinkling, and promotes proper drape of reversible necktie 10.

Reversible necktie 10 is manufactured by placing outside face 16 of side 12 in contact with outside face 32 of side 14. Sides 12 and 14 are sewn together along flat portions 30 and 40 of hems 26 and 36, respectively, by inside stitch line 42. Inside stitch line 42 is extended around reversible necktie 10, with the exception of a part of hems 26 and 36 at neck portion 52, which is left free and forms gap 54. The reversible necktie is then turned inside out, so that faces 16 and 32 of sides 12 and 14, respectively, are directed outward. Hems 26 and 36 curve inward; and inside stitch line 42 is effectively concealed by curved portions 28 and 38, and flat portions 30 and 40, of hems 26 and 36, respectively. Interfacing 58 is then inserted through gap 54; and positioned parallel to, and between, inside face 32 of side 14 and flat portion 40 of hem 36. The short length of outside lock stitch 56 is used to close gap 54. Since an outside lock stitch is employed to close gap 54 after assembly, gap 54 and outside lock stitch 56 are positioned in neck portion 52 of reversible necktie 10. It may be appreciated that outside lock stitch 56 is thus concealed from view by a shirt collar 60 when reversible necktie 10 is worn, as is shown in FIG. 1. Reversible necktie 10 is then pressed; and is ready for wearing.

Reversible necktie 10 is knotted and worn in the same manner as any conventional four-in-hand necktie. Reversible necktie 10 is knotted and worn with equal ease when either side 12 or side 14 is facing outward.

It may be appreciated that when either side 12 or side 14 becomes soiled, reversible necktie 10 may be quickly removed and reknotted so that the side opposite the soiled side is directed outward from the wearer. It may also be appreciated that, due to the symmetric construction of sides 12 and 14, and their respective hems 26 and 36, there is no overlap of material from one side to the other. Thus, the symmetric construction enhances the appearance of reversible necktie 10.

It may also be appreciated that reversible necktie 10 presents a number of economies to both the manufacturer and the ultimate user of reversible necktie 10. The manufacturer of reversible necktie 10 need not provide expensive liners or large hems, which are customarily employed on conventional neckties and add to the cost of manufacture. The hems 26 and 36 of reversible necktie 10 are considerably smaller than those found on conventional neckties, which extend to the center of the back of the necktie.

The wearer of the reversible necktie also realizes economies since he can effectively purchase two neckties with each purchase of a reversible necktie.

Although a specific embodiment of the herein-disclosed invention has been described in detail above, it is readily apparent that those skilled in the art may make various modifications and changes in the present invention without departing from the spirit and scope of the present invention. Therefore, the present invention is limited only by the appended claims

What is claimed is:

1. A reversible four-in-hand necktie comprising: a first side, said first side having a first outside face bearing a first pattern, said first side having a first inwardly-curving hem formed integral with the outer periphery of the first outside face, said first outside face having a pair of relatively widened ends, said relatively widened ends being connected by a relatively narrow neck band; a second side symmetric with said first side, said second side having a second outside face symmetric with said first outside face, said second side having a second inwardly-curving hem formed integral with the outer periphery of the second outside face, said second side being connected to said first side with the first and second inwardly-curved hems adjacent to each other, said second outside face bearing a second pattern, said second outside face having a pair of relatively widened second ends, said relatively widened second ends being connected by a relatively narrow second neck band; and an interfacing having the same shape as said second outside face, said interfacing being positioned between said second outside face and said second inwardly-curving hem, said interfacing providing support and drape for said first side and said second side.

2. A reversible four-in-hand necktie comprising: a first side, said first side having a first inside face and a first outside face, said first outside face bearing a first pattern, said first outside face having a pair of relatively widened pointed ends, one of said relatively widened pointed ends being wider than the other of said relatively widened pointed ends, said relatively widened pointed ends being connected by a relatively narrow neck band; said first side having a first inwardly-curving hem, said first inwardly-curving hem being tapered near said relatively widened pointed ends; a second side, said second side having a second inside face and a second outside face, said first and second outside faces being symmetric, said second outside face bearing a second pattern, said second side having a second inwardly-curving hem, said first and second inwardly-curving hems being symmetric, said second side being connected to said first side by a continuous inside stitch line along said first and second inwardly-curving hems, said continuous inside stitch line also being broken over a short distance; an outside lock stitch connecting said first and second inwardly-curving hems over said short distance; and a woven interfacing having the same shape as said first and second outside faces, said woven interfacing being positioned between said second inside face and said second inwardly-curving hem.

* * * * *